US006702619B2

(12) United States Patent
Kuroda et al.

(10) Patent No.: US 6,702,619 B2
(45) Date of Patent: Mar. 9, 2004

(54) HORIZONTAL ELECTRIC CONNECTOR

(75) Inventors: Keiji Kuroda, Amagasaki (JP); Daichi Miyamoto, Nissin (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/087,509

(22) Filed: Mar. 1, 2002

(65) Prior Publication Data

US 2002/0123268 A1 Sep. 5, 2002

(30) Foreign Application Priority Data

Mar. 5, 2001 (JP) ..... 2001-060986

(51) Int. Cl.[7] ..... H01R 24/00
(52) U.S. Cl. ..... 439/637; 439/733.1
(58) Field of Search ..... 439/637, 636, 439/660, 326, 733.1

(56) References Cited

U.S. PATENT DOCUMENTS

| | | | | | |
|---|---|---|---|---|---|
| 5,525,071 | A | * | 6/1996 | Obara et al. | 439/326 |
| 5,915,979 | A | * | 6/1999 | Schell et al. | 439/326 |
| 5,971,809 | A | * | 10/1999 | Ho | 439/660 |
| 5,993,234 | A | * | 11/1999 | Yodogawa | 439/326 |
| 6,024,582 | A | | 2/2000 | Wu | |
| 6,095,827 | A | * | 8/2000 | Dutkowsky et al. | 439/326 |
| 6,210,194 | B1 | * | 4/2001 | Choy | 439/326 |

FOREIGN PATENT DOCUMENTS

| | | |
|---|---|---|
| JP | 62-150675 | 7/1987 |
| JP | 63-139782 | 9/1988 |
| JP | 1-160679 | 11/1989 |
| JP | 06-283231 | 10/1994 |
| JP | 7-27059 | 5/1995 |
| JP | 10-040991 | 2/1998 |
| JP | 10-116658 | 5/1998 |
| JP | 2000-200638 | 7/2000 |
| JP | 2000-357548 | 12/2000 |
| TW | 422425 | 2/2001 |

* cited by examiner

*Primary Examiner*—P. Austin Bradley
*Assistant Examiner*—Edwin A. León
(74) *Attorney, Agent, or Firm*—W. F. Fasse; W. G. Fasse

(57) ABSTRACT

A horizontal electric connector includes an insulating housing, a first electric contact, with a contacting part that is press-fitted into the housing from the rear and contacts a counterpart conductive part, and a leg that extends from the contacting part, comes out of the housing at the rear and descends, and a second electric contact, with a contacting part that is press-fitted into the housing from the rear at a position lower than the first electric contact and contacts a counterpart conductive part, and a leg that extends from the contacting part, comes out of the housing at the rear and extends forward along the bottom of the housing. A leg supporting part is provided on the bottom of the housing, into which the leg of the second electric contact is press-fitted from the rear, to prevent deformation of the leg.

11 Claims, 10 Drawing Sheets

HORIZONTAL ELECTRIC CONNECTOR

BACKGROUND OF THE INVENTION

1. Field of the Invention

The present invention belongs to a field of electric connectors that are horizontally mounted on a printed circuit board, etc., and relates to a structure for supporting electric contacts on an insulating housing.

2. Related Art

A horizontal electric connector is known as one of the above-mentioned horizontal electric connectors. This horizontal electric connector comprises an insulating housing, a first electric contact, which has a contacting part that is fixed on the insulating housing and contacts a counterpart contact, and a leg that extends from the contacting part, comes out of the insulating housing at the rear thereof and descends, and a second electric contact, which has a contacting part that is fixed on the insulating housing at a position lower than that of the first electric contact and contacts a counterpart contact, and a leg that extends from the contacting part, comes out of the insulating housing at the rear thereof and extends forwards along the bottom of the insulating housing (for example, refer to Japanese Utility Model unexamined publication gazette Heisei 1-160679). This horizontal electric connector is mounted on a printed circuit board by placing the horizontal electric connector on the printed circuit board, with the bottom of the horizontal electric connector facing a face of the printed circuit board, and soldering the connecting part at the top end of each leg onto a conductive part of the printed circuit board. When, as explained above, the leg of the second electric contact coming out of the insulating housing at the rear thereof is guided forwards, the distance between the connecting part of the second electric contact and the connecting part of the first electric connector can be made greater in comparison with a case wherein the leg of the second electric connector, which is coming out of the insulating housing at the rear thereof, is made to descend directly. Accordingly, even if the electric connector is subjected to a force in the front-rear direction by insertion or removal of a counterpart electric connector, the forces to which the connecting parts are subjected by the force will be reduced, and moreover, troubles such as short circuits caused by a solder waste or the like caught between the connecting parts can be prevented.

In the case of the above-mentioned horizontal electric connector, the length of the second electric contact from the part fixed to the insulating housing to the connecting part is longer in comparison with a case wherein the second electric contact descends directly at the rear of the insulating housing. Because of this, the leg tends to be deformed due to external forces. If the leg is deformed, the bottom of the leg and the bottoms of legs of other second electric contacts will become irregular to each other, losing the coplanarity, or increasing the possibility of defective connection and short circuit. Herein, obtaining the coplanarity means that the faces of the electric contacts, which contact a printed circuit board or the like, constitute a single plane.

SUMMARY OF THE INVENTION

The present invention was made in view of these points, and one objective of the invention is to provide a horizontal electric connector that can stably obtain the coplanarity of the second electric contacts and reliably prevent defective connection and short circuit by supporting the leg of the second electric contact on the bottom of the insulating housing and preventing deformation of the leg in both the height direction and the width direction.

To accomplish the above-mentioned objective, the horizontal electric connector according to the present invention comprises an insulating housing having a front, a rear and a bottom, a first electric contact, which has a contacting part that is press-fitted into the insulating housing from the rear and contacts a counterpart conductive part, and a leg that extends from the contacting part, comes out of the insulating housing at the rear thereof and descends, a second electric contact, which has a contacting part that is press-fitted into the insulating housing from the rear at a position lower than that of the first electric contact and contacts a counterpart conductive part, and a leg that extends from the contacting part, comes out of the insulating housing at the rear thereof and extends forwards along the bottom of the insulating housing, and a leg supporting part, which is provided on the bottom of the insulating housing and into which the leg of the second electric contact is press-fitted from the rear.

When this horizontal electric connector is placed in such a way that its bottom faces a printed circuit board or the like, and the connecting parts at the top ends of the legs of the first electric contact and the second electric contact are soldered onto the printed circuit board or the like, the horizontal electric connector will be mounted onto the printed circuit board or the like. In this case, as the leg of the second electric contact extends forwards along the bottom, even if the horizontal electric connector is subjected to a force in the front-rear direction, the forces to which the connecting parts will be subjected will be reduced, and moreover, troubles, such as short circuit caused by a solder waste or the like caught between the connecting parts will be prevented. Furthermore, as the leg of the second electric contact is press-fitted into the leg supporting part on the bottom of the insulating housing from the rear, the leg will hardly undergo deformation in the height direction and the width direction. As a result, the coplanarity of the second electric contacts will be obtained reliably and defective connection and short circuit will be prevented.

Accordingly, the horizontal electric connector according to the present invention can reduce the force to which the connecting parts are subjected when the connector is subjected to a force in the front-rear direction because the leg of the second electric contact extends along the bottom of the connector. Moreover, the horizontal electric connector of the present invention can prevent occurrence of troubles such as a short circuit between connecting parts due to a solder waste, etc. As the leg of the second electric contact is supported on the bottom of the insulating housing, the leg hardly undergoes deformation in the height direction and the width direction, and the coplanarity of the second electric contacts can be obtained stably, and defective connection and short circuit can be prevented reliably.

DESCRIPTION OF PREFERRED EMBODIMENTS OF THE INVENTION

Figure 1:
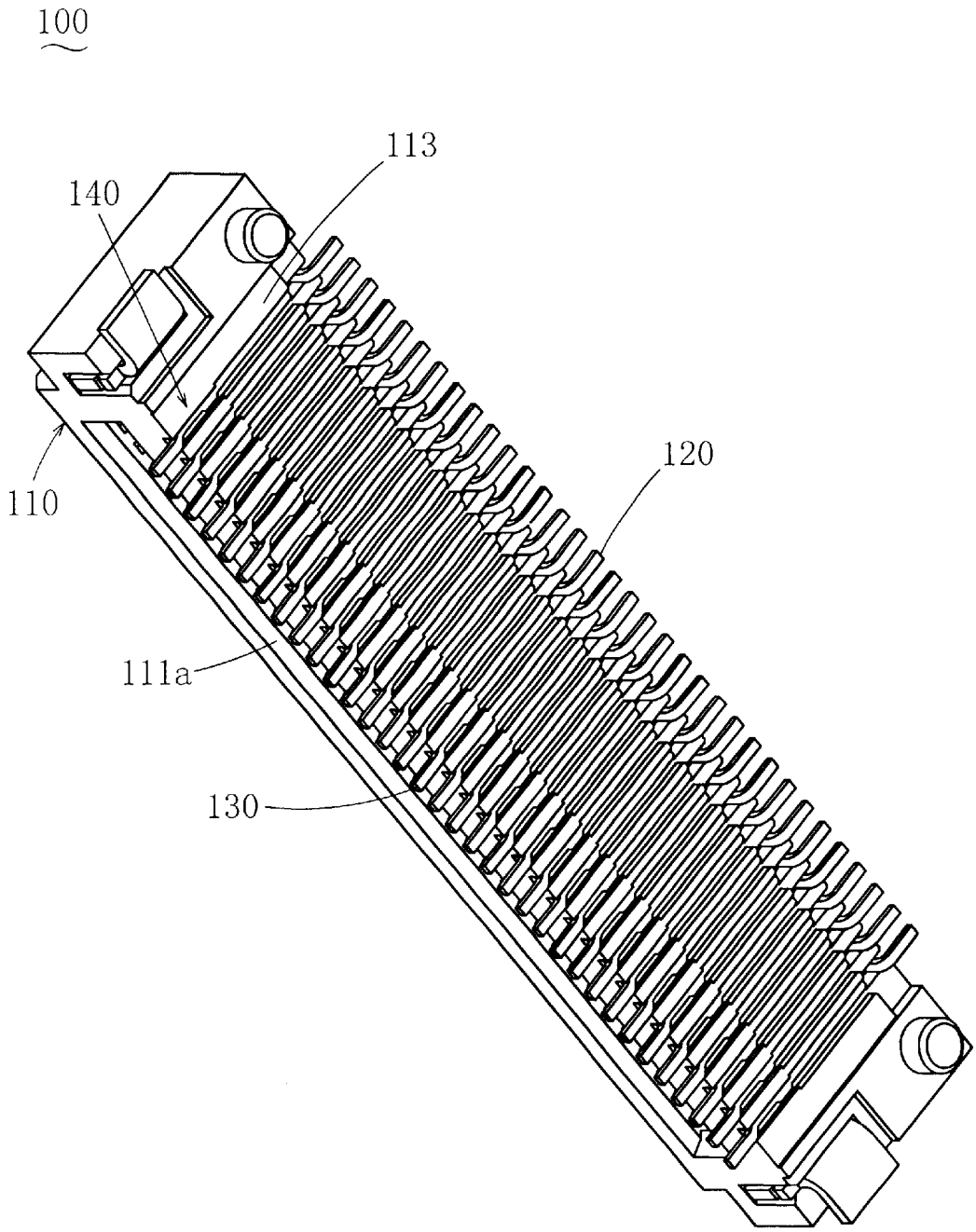
FIG. 1 is a perspective view of an embodiment of the horizontal electric connector according to the present invention.
Figure 2:
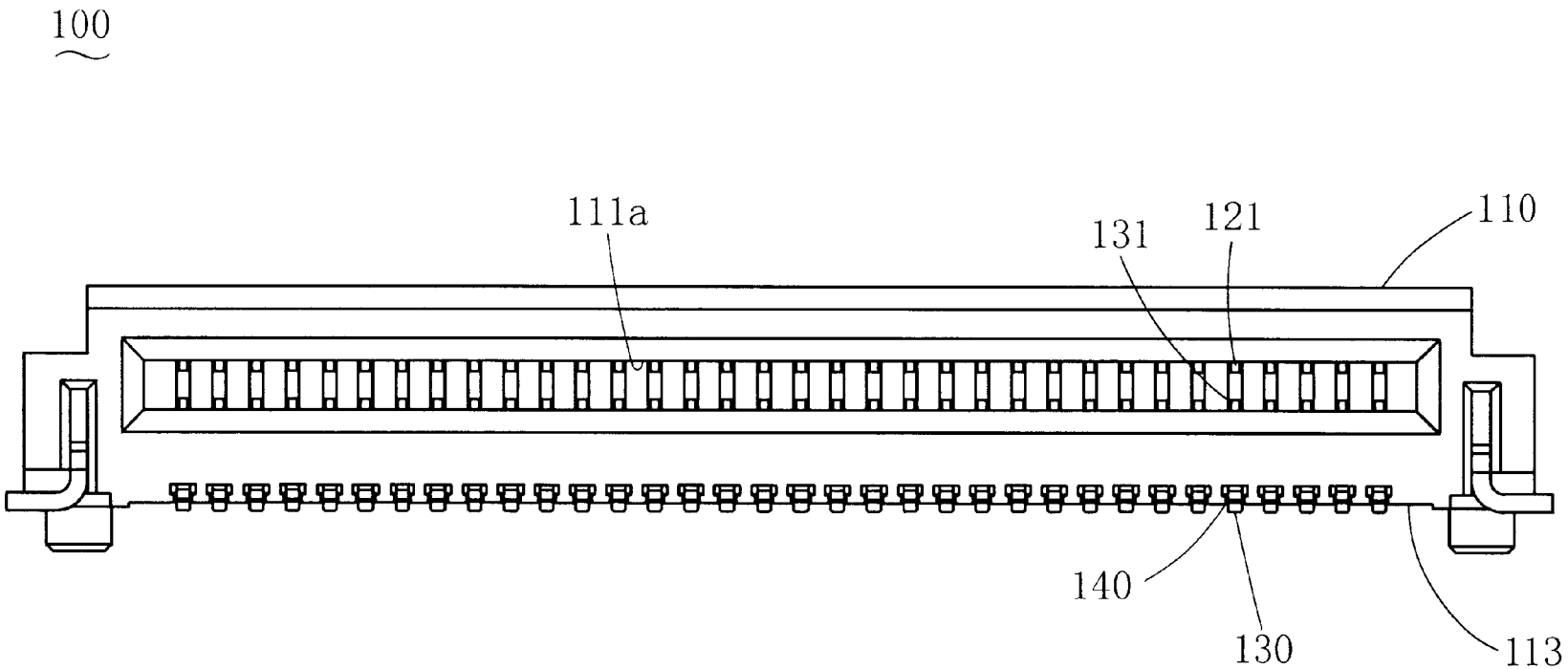
FIG. 2 is a front view of the embodiment of the horizontal electric connector.
Figure 3:
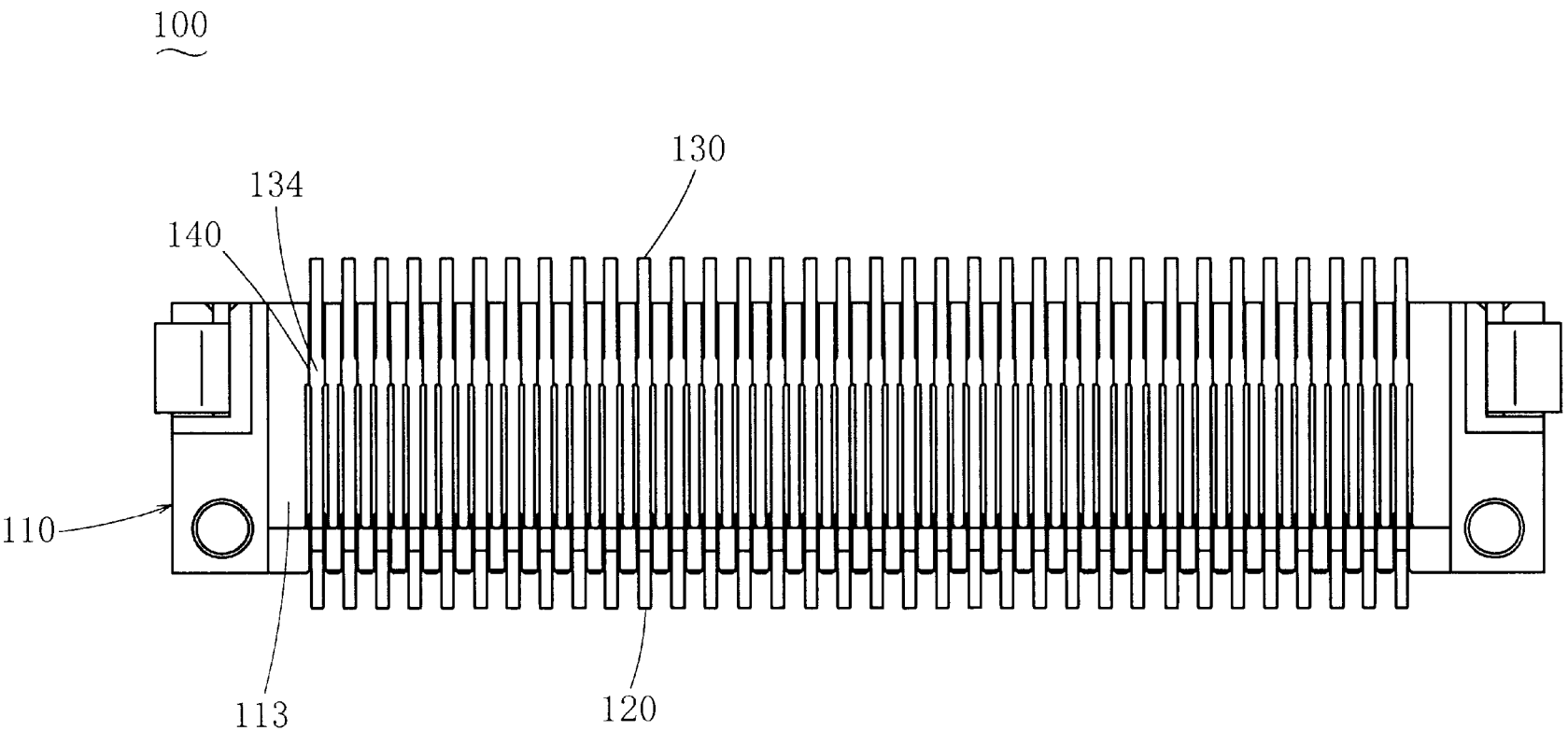
FIG. 3 is a bottom view of the embodiment of the horizontal electric connector.
Figure 4:
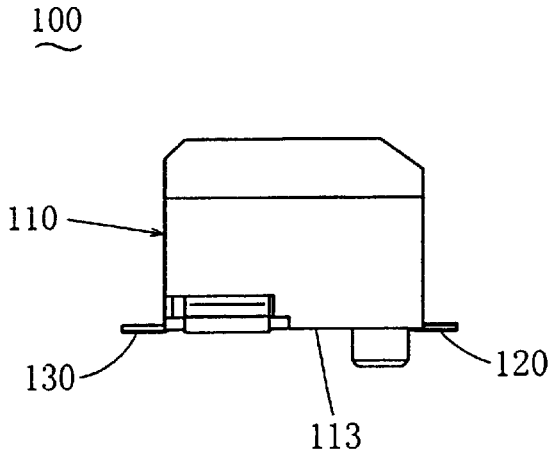
FIG. 4 is a side view of the embodiment of the horizontal electric connector.

In the following, some embodiments of the present invention will be described. FIG. 1 through FIG. 4 show a horizontal electric connector 100 being the embodiment. This electric connector 100 is a card-edge connector which is to be horizontally mounted on a printed circuit board 200, and the top end of an IC card or the like will be inserted, in a direction almost in parallel with the printed circuit board 200, into the electric connector 100 through an insertion port that opens in one end of the electric connector 100.

In FIG. 1 through FIG. 4, 110 denotes an insulation housing that is formed of an insulating material such as resin. A chamber 111 is formed in this insulating housing 110. The chamber 111 is open rearwards. A receiving port 111*a* for receiving an IC card or the like, which is through to the chamber 111, is formed at the front of the insulating housing 110. A first electric contact 120 and a second electric contact 130 are press-fitted into the insulating housing 110 from the rear thereof. In this way, portions of the first electric contact 120 and the second electric contact 130 that are exposed forwards through the receiving port 111*a* are reduced. At least a pair of the first electric contact 120 and the second electric contact 130 are provided, and the first electric contact 120 is press-fitted on an upper side and the second electric contact 130 on a lower side, respectively.

Figure 5:
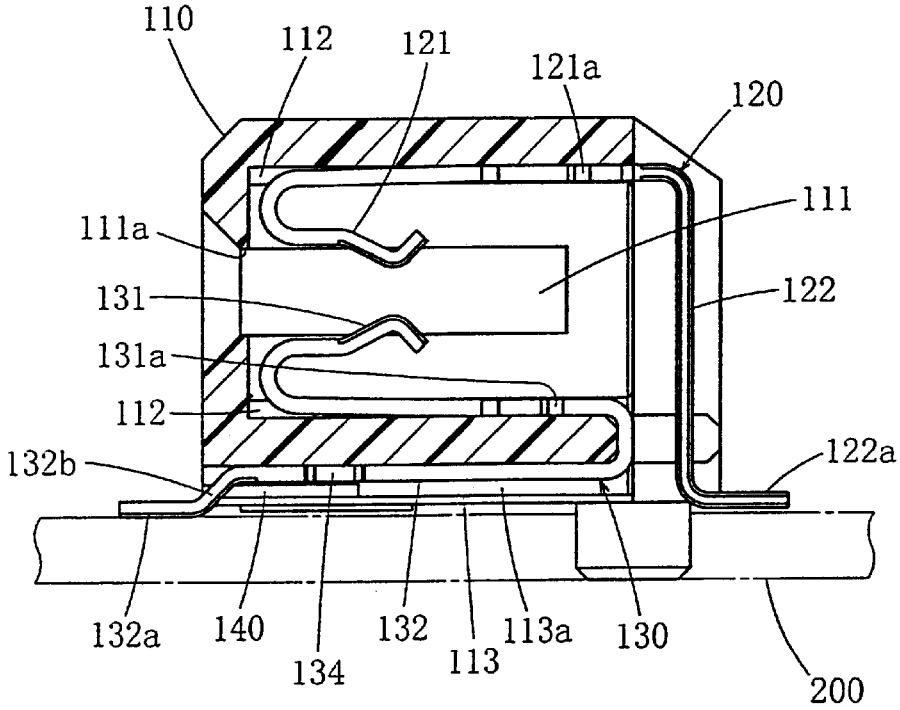
FIG. 5 is an enlarged view of the embodiment of the horizontal electric connector. It is sectioned longitudinally and seen from its side.
Figure 6:
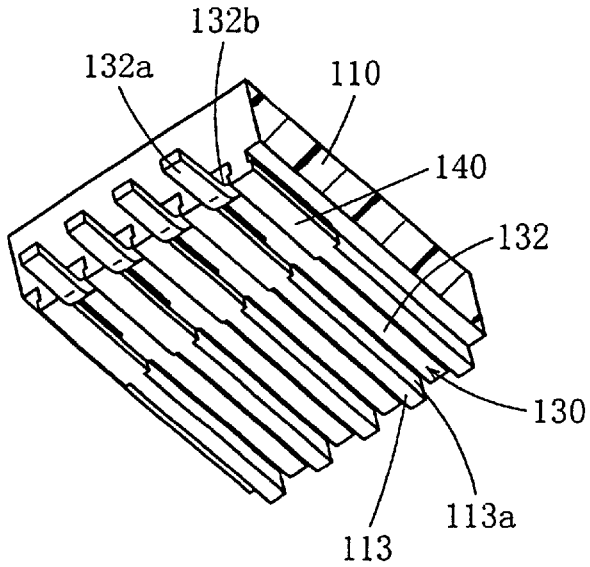
FIG. 6 is an enlarged perspective view of a portion around the leg supporting part of the embodiment of the horizontal electric connector. It is seen from the lower front.
Figure 7:
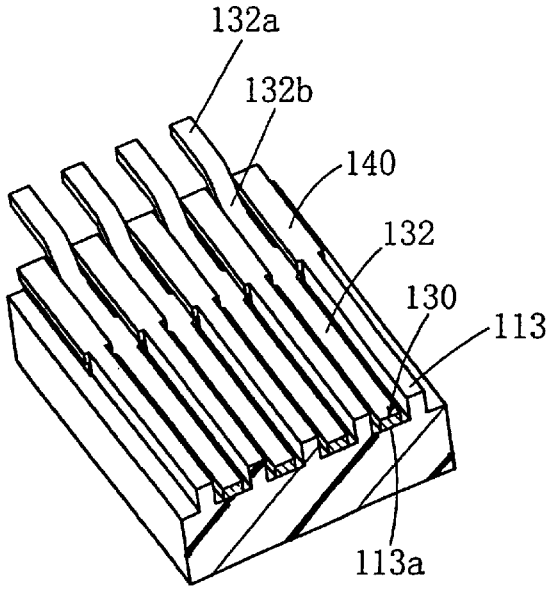
FIG. 7 is an enlarged perspective view of a portion around the leg supporting part of the embodiment of the horizontal electric connector. It is seen from the lower rear.
Figure 8:
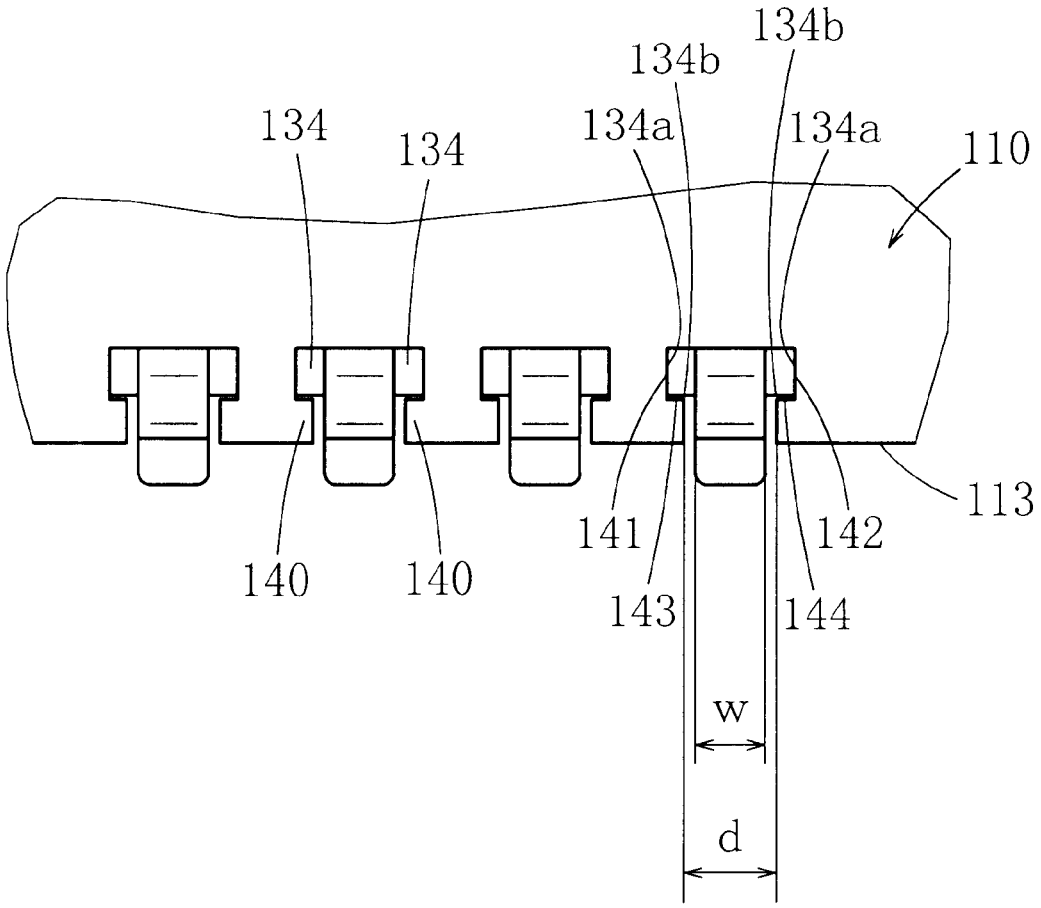
FIG. 8 is an enlarged front view of a portion around the leg supporting part of the embodiment of the horizontal electric connector.

As shown in FIG. 5, the first electric contact 120 is provided with a contacting part 121 and a leg 122. The contacting part 121 is press-fitted into the insulating housing 110 from the rear thereof and protrudes into and is exposed in the chamber 111 where it contacts a counterpart conductive part being a conductive part of an IC card or the like. A wider press-fitting part 121*a* is formed in the contacting part 121, and this press-fitting part 121*a* is press-fitted into a press-fitting groove 112 on the insulating housing 110. The leg 122 extends from this contacting part 121, comes out of the insulating housing 110 at the rear thereof and descends. A connecting part 122*a*, which is to be soldered onto the printed circuit board 200, is formed at the bottom free end of the leg 122. The second electric contact 130 is provided with a contacting part 131 and a leg 132. The contacting part 131 is press-fitted into the insulating housing 110 from the rear thereof, at a position that is lower than that of the first electric contact 120, and protrudes into and is exposed in the chamber 111 where it contacts a counterpart conductive part being a conductive part of the IC card or the like. A wider press-fitting part 131*a* is formed in the contacting part 131, and this press-fitting part 131*a* is press-fitted into a press-fitting groove 112 of the insulating housing 110. The leg 132 extends from the contacting part 131, comes out of the insulating housing 110 at the rear thereof, and extends forward along the bottom 113 of the insulating housing 110. A connecting part 132*a*, which is to be soldered onto the printed circuit board 200, formed at the bottom free end of the leg 132.

Figure 9:
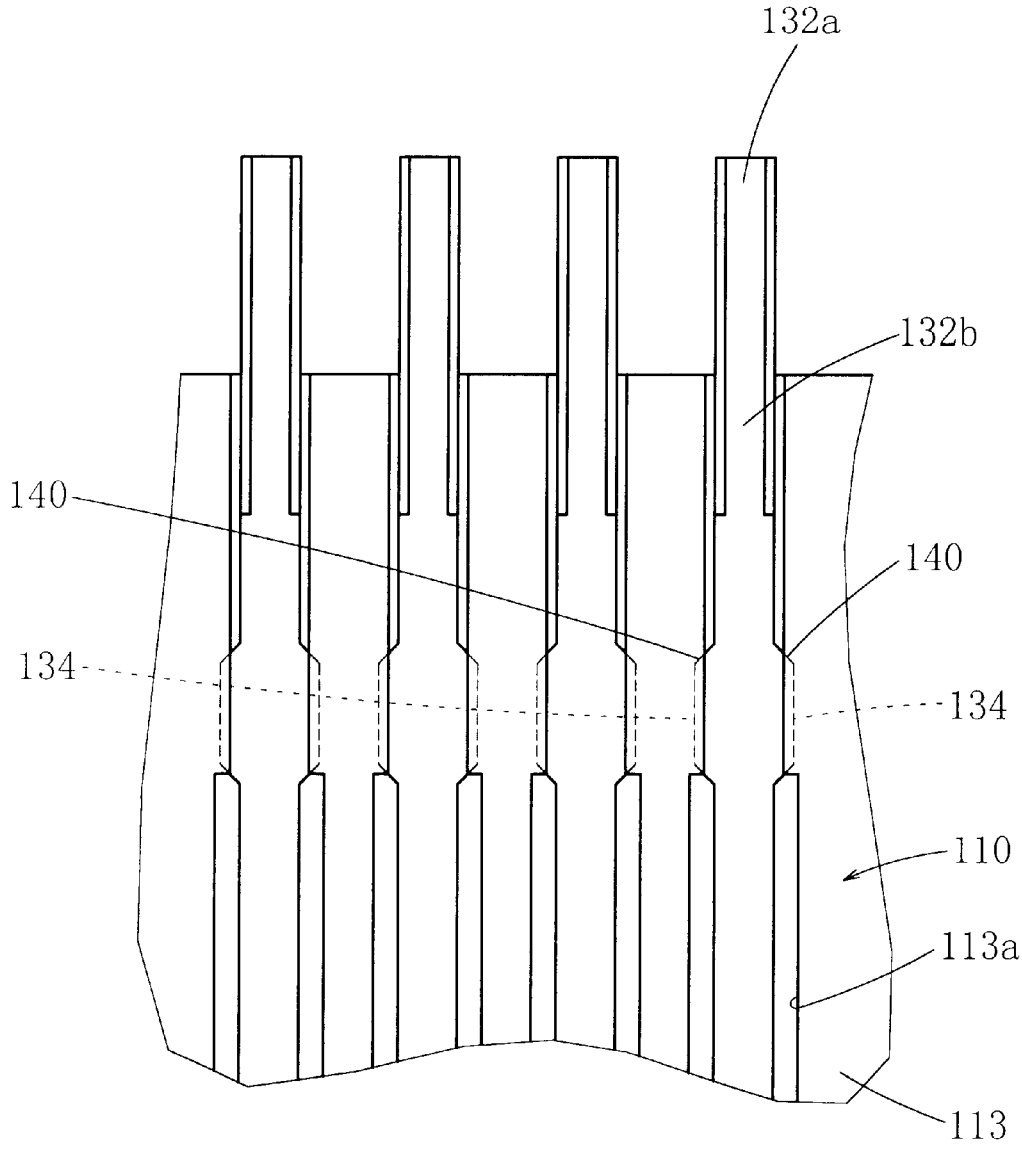
FIG. 9 is an enlarged bottom view of a portion around the leg supporting part of the embodiment of the horizontal electric connector.
Figure 10:
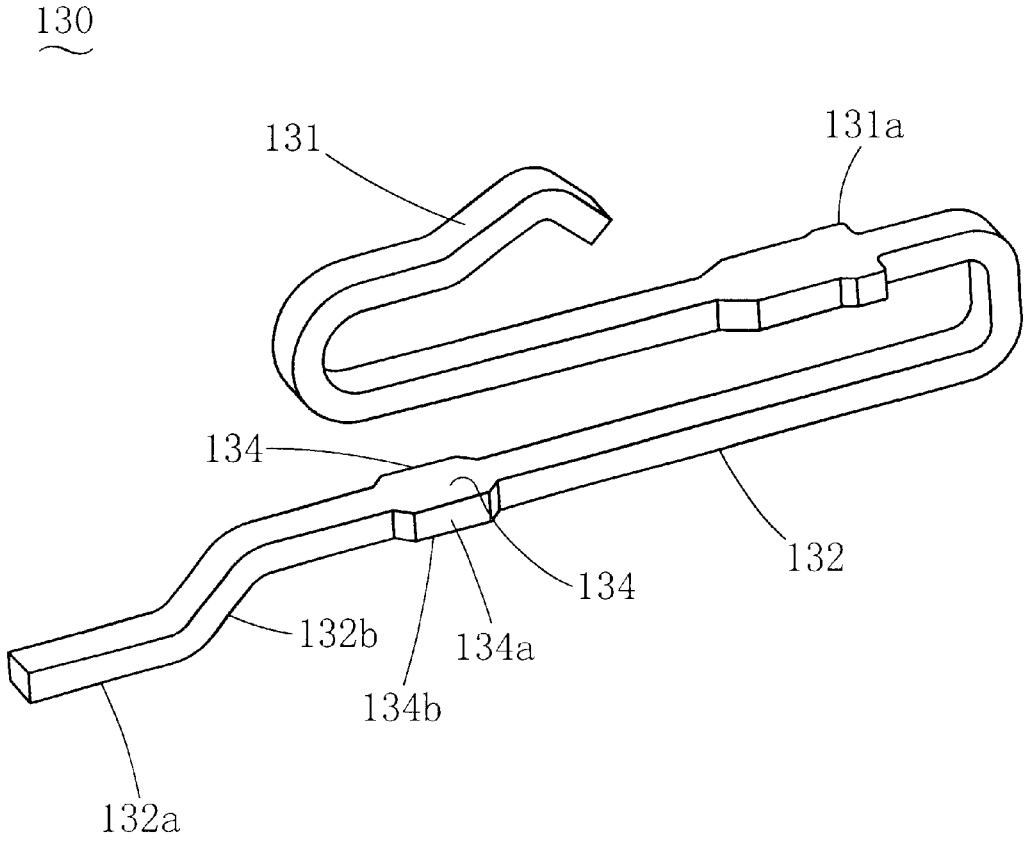
FIG. 10 is an enlarged perspective view of the second electric contact of the embodiment of the horizontal electric connector.
Figure 11:
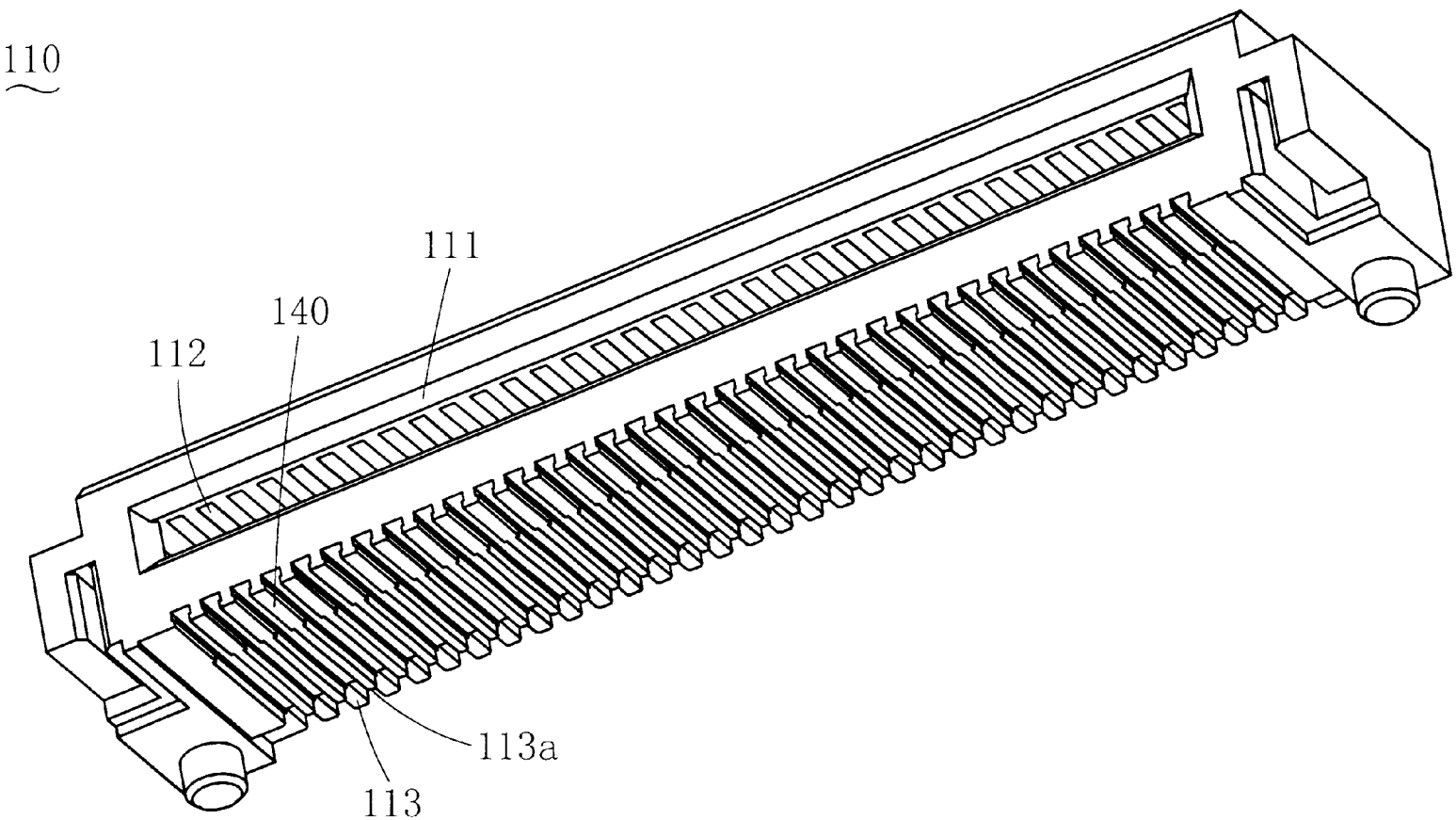
FIG. 11 is a perspective view of the insulating housing of the embodiment of the horizontal electric connector.

As shown in FIG. 6 through FIG. 9, a leg supporting part 140, into which the leg 132 of the second electric contact 130 is press-fitted from the rear, is provided on the bottom 113 of the insulating housing 110. The leg 132 of the second electric contact 130 comes out of the insulating housing 110 at the rear thereof, extends forward along the bottom 113 of the insulating housing 110, and then descends away from the bottom 113 downward, and a connecting part 132*a* is formed at the bottom free end of the leg 132. Protruding parts 134, which protrude on both sides in the width direction, are formed in the part of the leg 132, which is along the bottom 113 of the insulating housing 110. As shown in FIG. 9 and FIG. 10, the protruding parts 134 on both sides may be formed at the same position in the front-rear direction or may be staggered from each other in the front-rear direction. The leg supporting part 140 is provided with a left vertical wall 141 and a right vertical wall 142, which respectively contact faces 134*a* in the width direction of the protruding parts 134, as well as horizontal walls 143, 144, which extend sidewise from the vertical walls 141, 142 and contact the bottoms 134*b* of the protruding parts 134 and are apart from each other by a distance d, which is not less than the width w of the descending part 132*b* of the leg 132 (namely $d \geqq w$).

As shown in FIG. 5 through FIG. 9, a guide groove 113*a*, which holds the leg 132 of the second electric contact 130, is formed in the bottom 113 of the insulating housing 110, and the leg supporting part 140 is formed on this guide groove 113*a*. The leg supporting part 140 is provided in the front part of the bottom 113 of the insulating housing 110. In other words, the guide groove 113*a* having a U-shaped section is formed in the insulating housing 110 from the rear face to the front face of the insulating housing 110. The width of the guide groove 113*a* corresponds to the distance from the face 134*a* of one protruding part 134 of the leg 132 to the face 134*a* of the other protruding part 134. In the front part of the guide groove 113*a*, the left and right vertical walls of the guide groove 113*a* constitute the left and right vertical walls 141, 142 of the leg supporting part 140. Moreover, at the bottoms of the left and right vertical walls of the guide groove 113*a*, horizontal walls extend towards the opposing vertical walls, and the top ends of these horizontal walls are apart by the distance d, which is not less than the width w of the descending part 132*b* of the leg 132. These horizontal walls constitute the horizontal walls 143, 144 of the leg supporting part 140.

Accordingly, when the horizontal electric connector 100 according to the embodiment is placed on the printed circuit board 200 in such a way that the bottom 113 of the connector 100 faces the board 200, and the connecting parts 122*a*, 132*a* at the bottom free ends of the legs 122, 132 of the first electric connector 120 and the second electric connector 130 are soldered onto the printed circuit board 200, the horizontal electric connector 100 will be mounted onto the printed circuit board 200. In this case, as the leg 132 of the second electric contact 130 extends forward along the bottom 113, even if the horizontal electric connector 100 is subjected to a force in the front-rear direction, the forces which the connecting parts 122*a*, 132*a* receive will be reduced, and troubles such as a short circuit between the connecting parts 122*a*, 132*a* due to a solder waste, etc. will be prevented. Moreover, as the leg 132 of the second electric contact 130 is press-fitted into the leg supporting part 140 from the rear at the bottom 113 of the insulating housing 110, the leg 132 will hardly undergo deformation in the height direction and the width direction. Hence, the coplanarity of the second electric contacts 130 will be obtained reliably and a defective connection and a short circuit will be prevented.

Figure 12:
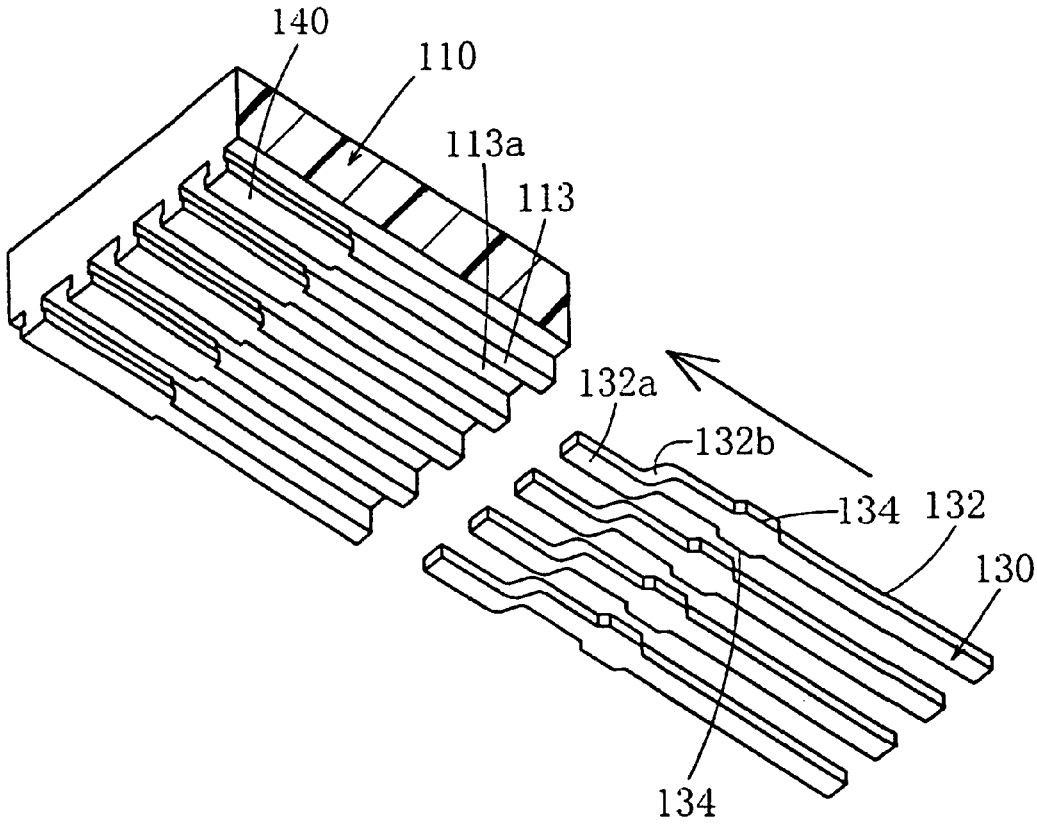
FIG. 12 is an enlarged perspective view showing the second electric contact being assembled into the insulating housing of the embodiment of the horizontal electric connector.

The present invention includes embodiments of the horizontal electric connector wherein the portion of the leg of the second electric contact, which extends forwards along the bottom of the insulating housing, is linear. In contrast to them, in the horizontal electric connector 100 of the above-mentioned embodiment, the leg 132 of the second electric contact 130 first extends forwards along the bottom 113 of the insulating housing 110 and then descends away from the bottom 113 downwards, and the part of the leg 132 that extends along the bottom 113 of the insulating housing 110 is provided with protruding parts 134 that protrude on both sides in the width direction. Moreover, the leg supporting part 140 is provided with the left and right vertical walls 141, 142, which contact the faces 134*a* in the width direction of the protruding parts 134, and horizontal walls 143, 144, which extend sidewise from the respective vertical walls 141, 142, contact the bottoms 134*b* of the protruding parts 134*a* and are apart from each other by a distance that is not less than the width of the descending part 132*b* of the leg 132. With this arrangement, as shown in FIG. 12, when the second electric contact 130 is to be assembled into the insulating housing 110, if the second electric contact 130 is brought to the insulating housing 110 from the rear thereof, the descending part 132*b* of the leg 132 will pass between the horizontal walls 143, 144 of the leg supporting part 140 and move forwards, and the protruding parts 134 will be inserted into a space between the bottom 113 of the insulating housing 110 and the horizontal walls 143, 144 of the leg supporting part 140 and between the vertical walls 141, 142 of the leg supporting part 140. Hence displacement of the protruding parts 134 in the height direction will be limited between the bottom 113 of the insulating housing 110 and the horizontal walls 143, 144 of the leg supporting part 140, and displacement thereof in the width direction will be limited between the vertical walls 141, 142 of the leg supporting part 140.

The present invention includes embodiments wherein the portion of the bottom of the insulating housing along which the leg of the second electric contact extends is formed flat in the width direction. In contrast to them, in the horizontal electric connector 100 of the above-mentioned embodiment, the guide groove 113*a* for holding the leg 132 of the second electric contact 130 is formed in the bottom 113 of the insulating housing 110, and the guide groove 113*a* is provided with the leg supporting part 140. With this arrangement, as shown in FIG. 12, when the second electric contact 130 is to be assembled into the insulating housing 110, if the second electric contact 130 is brought to the insulating housing 110 from the rear, the leg 132 will be guided along the guide groove 113*a* into the leg supporting part 140. Hence the workability of assembly is good, and deformation of the second electric contact 130 will be prevented during assembly.

The present invention includes embodiments wherein the leg supporting part is provided in the middle part or the rear part of the bottom of the insulating housing. In contrast to them, in the horizontal electric connector 100 of the above-mentioned embodiment, the leg supporting part 140 is provided in the front part of the bottom 113 of the insulating housing 110. With this arrangement, as shown in FIG. 12, when the second electric contact 130 is to be assembled into the insulating housing 110, if the second electric contact 130 is brought to the insulating housing 110 from the rear, the second electric contact 130 will be press-fitted into the leg supporting part in the last stage of the assembling procedure. Hence the workability of assembly is good, and the second electric contact 130 will be prevented from deformation during assembly.

In the above-mentioned embodiment, the present invention was described by applying the invention to a card-edge connector into which or from which an IC card or the like is inserted or extracted. The present invention can also be applied, for example, to male or female horizontal electric connectors into which or from which a counterpart electric connector is inserted or extracted. In such a case, the conductive part of the counterpart is a male or female electric contact of the counterpart electric connector. Moreover, the present invention is extensively applicable to horizontal electric connectors having a structure wherein the electric contacts are press-fitted into the insulation housing from the rear. Hence the present invention includes embodiments wherein the chamber and the receiving port of the above-mentioned embodiment are not provided. The present invention also includes embodiments wherein the insulating housing is provided with a plurality of the first electric contacts being arranged in an upper layer and a lower layer and the second electric contacts are press-fitted into the insulating housing from the rear at positions being lower than those of the first electric contacts.

With the description of these embodiments, the first horizontal electric connector, which was described in the summary of the invention, has been fully disclosed. Moreover, with the description of these embodiments, the second through fourth horizontal electric connectors, which will be described below, have been fully explained.

The second horizontal electric connector is a horizontal electric connector as recited in the above-mentioned first horizontal electric connector, wherein the leg of the second electric contact has a width and extends forward along the bottom of the insulating housing then descends away from the bottom downward, the part of the leg extending along the bottom of the insulating housing is provided with protruding parts which protrude on both sides in the width direction, and the leg supporting part is provided with a left vertical wall and a right vertical wall, which contact faces in the width direction of the protruding parts, and horizontal walls, which extend sidewise from the vertical walls and contact the bottoms of the protruding parts and are apart from each other by a distance which is not less than the width of the descending part of the leg. With this arrangement, when the second electric contact is to be assembled into the insulating housing, if the second electric contact is brought to the insulating housing from the rear, the descending part of the leg will pass between the horizontal walls of the leg supporting part to move forward, and the protruding parts will be inserted into a space between the bottom of the insulating housing and the horizontal walls of the leg supporting part and between the vertical walls of the leg supporting part. Hence deformation of the protruding parts will be limited in the height direction between the bottom of the insulating housing and the horizontal walls of the leg supporting part and in the width direction between the vertical walls of the leg supporting part. Accordingly, the present invention is applicable to a horizontal electric connector wherein a part descending from the bottom downward is provided at the forward end of the part of the leg of the second electric contact extending along the bottom of the insulating housing.

The third horizontal electric connector is a horizontal electric connector as recited in the above-mentioned first or second horizontal electric connector, wherein a guide groove for holding the leg of the second electric contact is formed in the bottom of the insulating housing, and the guide groove is provided with the leg supporting part. With this arrangement, when the second electric contact is to be assembled into the insulating housing, if the second electric contact is brought to the insulating housing from the rear, the leg will be guided into the leg supporting part along the guide groove. As the leg of the second electric contact can be guided smoothly into the leg supporting part along the guide groove, the workability of assembly is good and deformation of the second electric contact can be prevented during assembly.

The fourth horizontal electric connector is a horizontal electric connector as recited in any one of the above-mentioned first through third horizontal electric connectors, wherein the leg supporting part is provided in the front part of the bottom of the insulating housing. With this arrangement, when the second electric contact is to be assembled into the insulating housing, if the second electric contact is brought to the insulating housing from the rear, the second electric contact will be press-fitted into the leg supporting part in the final stage of the assembling procedure. Hence the workability of assembly is good, and deformation of the second electric contact at the time of assembly will be prevented.

What is claimed is:

1. A horizontal electric connector comprising an insulating housing having a front, a rear and a bottom, as well as a leg supporting part on the bottom, a first electric contact, which has a first contacting part that is press-fitted into the insulating housing from the rear and is adapted to contact a first counterpart conductive part, and a first leg that extends from the first contacting part, comes out of the insulating housing at the rear thereof and descends to terminate in a first connecting terminal of the first electric contact, and a second electric contact, which has a second contacting part that is press-fitted into the insulating housing from the rear at a position closer to the bottom than that of the first contacting part of the first electric contact and is adapted to contact a second counterpart conductive part, and a second leg that extends from the second contacting part, comes out of the insulating housing at the rear thereof and from the rear has a forwardly extending portion that extends forward toward the front along the bottom of the insulating housing to terminate in a second connecting terminal of the second electric contact, wherein the forwardly extending portion of the second leg of the second electric contact which extends toward the second connecting terminal is press-fitted into the leg supporting part so as to constrain motion and deformation of the forwardly extending portion of the second leg in a width direction and a height direction respectively orthogonal to an extension direction in which the forwardly extending portion extends, the forwardly extending portion of the second leg of the second electric contact has a width in the width direction, and the second leg further includes a descending portion that descends away from the bottom downward toward the second connecting terminal, the forwardly extending portion of the second leg is provided with protruding parts which protrude on both sides in the width direction, and the leg supporting part is provided with a left vertical wall and a right vertical wall, which contact faces in the width direction of the protruding parts, and horizontal walls which extend sidewise from the vertical walls and contact bottoms of the protruding parts and are spaced a art from each other by a distance which is not less than the width of the descending portion of the second leg.

2. A horizontal electric connector as recited in claim 1, wherein the leg supporting part is provided in a front part of the bottom of the insulating housing adjoining the front of the insulating housing.

3. A horizontal connector as recited in claim 1, wherein the insulating housing has a chamber therein, and a receiving port in the front of the insulating housing that opens into the chamber, and wherein the first contacting part and the second contacting part are both arranged in common together in the chamber to be respectively contacted by the first counterpart conductive part and the second counterpart conductive part.

4. A horizontal electric connector as recited in claim 1, wherein a guide groove for holding the forwardly extending portion of the second leg of the second electric contact is formed in the bottom of the insulating housing, and the guide groove is provided with the leg supporting part.

5. A horizontal electric connector as recited in claim 4, wherein the leg supporting part is provided in a front part of the bottom of the insulating housing adjoining the front of the insulating housing.

6. A horizontal electric connector comprising an insulating housing having a front, a rear and a bottom, a first electric contact, which has a contacting part that is press-fitted into the insulating housing from the rear and contacts a counterpart conductive part, and a leg that extends from the contacting part, comes out of the insulating housing at the rear thereof and descends, a second electric contact, which has a contacting part that is press-fitted into the insulating housing from the rear at a position lower than that of the first electric contact and contacts a counterpart conductive part, and a leg that extends from the contacting part, comes out of the insulating housing at the rear thereof and extends forward along the bottom of the insulating housing, and a leg supporting part, which is provided on the bottom of the insulating housing and into which the leg of the second electric contact is press-fitted from the rear, wherein the leg of the second electric contact has a width and extends forward along the bottom of the insulating housing then descends away from the bottom downward, the part of the leg extending along the bottom of the insulating housing is provided with protruding parts which protrude on both sides in the width direction, and the leg supporting part is provided with a left vertical wall and a right vertical wall, which contact feces in the width direction of the protruding parts, and horizontal walls, which extend sidewise from the vertical walls and contact the bottoms of the protruding parts and are apart from each other by a distance which is not less than the width of the descending part of the leg.

7. A horizontal electric connector as recited in claim 6, wherein a guide groove for holding the leg of the second electric contact is formed in the bottom of the insulating housing, and the guide groove is provided with the leg supporting part.

8. A horizontal electric connector as recited in claim 6, wherein the leg supporting part is provided in the front part of the bottom of the insulating housing.

9. A horizontal electric connector comprising an insulating housing having a front, a rear and a bottom, as well as a leg supporting part on the bottom, a first electric contact, which has a first contacting part that is press-fitted into the insulating housing from the rear and is adapted to contact a first counterpart conductive part, and a first leg that extends from the first contacting part, comes out of the insulating housing at the rear thereof and descends to terminate in a first connecting terminal of the first electric contact, and a second electric contact, which has a second contacting part that is press-fitted into the insulating housing from the rear at a position closer to the bottom than that of the first contacting part of the first electric contact and is adapted to contact a second counterpart conductive part, and a second leg that extends from the second contacting part, comes out of the insulating housing at the rear thereof and from the rear has a forwardly extending portion that extends forward toward the front along the bottom of the insulating housing to terminate in a second connecting terminal of the second electric contact, wherein the forwardly extending portion of the second leg of the second electric contact which extends toward the second connecting terminal is press-fitted into the leg supporting part so as to constrain motion and deformation of the forwardly extending portion of the second leg in a width direction and a height direction respectively orthogonal to an extension direction in which the forwardly extending portion extends, and the forwardly extending portion of the second leg is linearly straight as it extends from the rear of the insulating housing and into the leg supporting part.

10. A horizontal electric connector as recited in claim 9, wherein a guide groove for holding the forwardly extending portion of the second leg of the second electric contact is formed in the bottom of the insulating housing, and the guide groove is provided with the leg supporting part.

11. A horizontal electric connector as recited in claim 9, wherein the leg supporting part is provided in a front part of the bottom of the insulating housing adjoining the front of the insulating housing.

* * * * *

UNITED STATES PATENT AND TRADEMARK OFFICE

CERTIFICATE OF CORRECTION

PATENT NO. : 6,702,619 B2
DATED : March 9, 2004
INVENTOR(S) : Kuroda et al.

It is certified that error appears in the above-identified patent and that said Letters Patent is hereby corrected as shown below:

Column 4,
Line 11, after “200,”, insert -- is --;

Column 8,
Line 13, after “spaced”, replace “a art” by -- apart --;
Line 67, after “contact”, replace “feces” by -- faces --.

Signed and Sealed this

Twenty-second Day of June, 2004

JON W. DUDAS
*Acting Director of the United States Patent and Trademark Office*